US009297570B2

(12) United States Patent
Tippmann

(10) Patent No.: US 9,297,570 B2
(45) Date of Patent: Mar. 29, 2016

(54) RACK-AISLE FREEZING SYSTEM FOR PALLETIZED PRODUCT

(71) Applicant: Daniel J. Tippmann, Fort Wayne, IN (US)

(72) Inventor: Daniel J. Tippmann, Fort Wayne, IN (US)

(73) Assignee: Tippmann Companies LLC, Fort Wayne, IN (US)

( * ) Notice: Subject to any disclaimer, the term of this patent is extended or adjusted under 35 U.S.C. 154(b) by 98 days.

(21) Appl. No.: 14/302,125

(22) Filed: Jun. 11, 2014

(65) Prior Publication Data

US 2014/0345303 A1 Nov. 27, 2014

Related U.S. Application Data

(63) Continuation of application No. 12/877,392, filed on Sep. 8, 2010, now Pat. No. 8,783,047.

(60) Provisional application No. 61/241,065, filed on Sep. 10, 2009.

(51) Int. Cl.

| | |
|---|---|
| ***F25D 13/00*** | (2006.01) |
| ***F25D 31/00*** | (2006.01) |
| ***F25D 17/00*** | (2006.01) |

(52) U.S. Cl.

CPC ..... *F25D 13/00* (2013.01); *F25D 17/005* (2013.01); *F25D 31/00* (2013.01); *F25D 2317/0664* (2013.01)

(58) Field of Classification Search

CPC ..... F25D 13/00; F25D 17/005; F25D 31/00; F25D 2317/0664; F25D 17/06; F25D 17/067

USPC ..... 62/62, 259.1

See application file for complete search history.

(56) References Cited

U.S. PATENT DOCUMENTS

| | | | |
|---|---|---|---|
| 206,140 | A | 7/1878 | Rumbaugh |
| 239,345 | A | 3/1881 | Sanford |
| 677,536 | A | 7/1901 | Cooper |
| 1,813,187 | A | 7/1931 | Moore |
| 2,240,377 | A | 4/1941 | Preble |
| 3,545,223 | A | 12/1970 | Elland |
| 3,621,672 | A | 11/1971 | Meredith |
| 3,972,279 | A | 8/1976 | Powers |
| 4,063,432 | A | 12/1977 | Chaussy et al. |

(Continued)

OTHER PUBLICATIONS

Heldman, Dennis R., "Optimizing the Food Freezing Process for Maximum Product Quality", WFLO Research Project #144, Sep. 2003.

(Continued)

*Primary Examiner* — Mohammad M Ali

(74) *Attorney, Agent, or Firm* — Faegre Baker Daniels LLP

(57) ABSTRACT

An installation and method for freezing and cold storage of palletized product. A chiller is provided in the interior of a cold storage warehouse space that maintains the temperature of ambient air within the space below freezing. A plurality of racking structures each define an air flow chamber having air intake openings on opposite sides thereof and an air outlet to enable freezing air to be drawn into the chamber through the intake openings and exhausting into the warehouse space. Pallets on pallet guides are pressed against the intake openings such that freezing air is drawn through the palletized product to thereby quickly freeze the product. The pallet structure and air flow chambers are arranged in spaced-apart rows to enable a forklift to pass down the aisles so as to place and remove the palletized product.

22 Claims, 10 Drawing Sheets

(56) References Cited

U.S. PATENT DOCUMENTS

| | | | | |
|---|---|---|---|---|
| 4,082,194 | A | 4/1978 | Sheehan | |
| 4,425,768 | A | 1/1984 | Burns | |
| 4,736,592 | A * | 4/1988 | Ohling | A23L 3/364 62/187 |
| 4,824,685 | A | 4/1989 | Bianco | |
| 4,989,417 | A | 2/1991 | Markiewicz | |
| 5,054,291 | A | 10/1991 | Davis et al. | |
| 5,215,421 | A | 6/1993 | Smith | |
| 5,401,520 | A | 3/1995 | Skaar et al. | |
| 5,520,006 | A | 5/1996 | Middleton | |
| 5,778,557 | A | 7/1998 | Leavens | |
| 5,791,150 | A * | 8/1998 | Bosher | F25D 11/003 62/236 |
| 5,896,218 | A | 4/1999 | Hunter et al. | |
| 5,965,185 | A | 10/1999 | Bianco | |
| 6,012,384 | A | 1/2000 | Badalament et al. | |
| 6,405,644 | B1 | 6/2002 | Windecker | |
| 6,419,087 | B1 | 7/2002 | Peters | |
| 6,431,060 | B1 | 8/2002 | Gutheim | |
| 6,446,056 | B1 | 9/2002 | Kiefer et al. | |
| 6,615,908 | B1 | 9/2003 | Bosher et al. | |
| 6,796,142 | B2 * | 9/2004 | Burn | F25D 25/04 62/380 |
| 6,901,768 | B1 | 6/2005 | Windecker | |
| 6,923,111 | B2 | 8/2005 | Kiefer et al. | |
| 7,017,366 | B2 | 3/2006 | Bottom | |
| 7,178,356 | B1 | 2/2007 | Lingelbach | |
| 7,263,855 | B2 * | 9/2007 | Meyer | F25D 11/003 62/371 |
| 7,516,624 | B2 | 4/2009 | Weeth | |
| 7,946,124 | B2 | 5/2011 | Klysen | |
| 8,371,140 | B2 * | 2/2013 | Holmes | F25D 3/125 62/239 |
| 2004/0177795 | A1 | 9/2004 | Salmanson et al. | |
| 2006/0185528 | A1 | 8/2006 | Tippmann et al. | |
| 2006/0207284 | A1 | 9/2006 | Lehmann et al. | |
| 2006/0254434 | A1 * | 11/2006 | Perryman | F25D 17/005 99/467 |
| 2006/0272350 | A1 | 12/2006 | Weeth | |
| 2007/0169503 | A1 | 7/2007 | Kikuchi et al. | |
| 2008/0178616 | A1 | 7/2008 | Klysen | |
| 2009/0196971 | A1 * | 8/2009 | Weeth | F25D 17/06 426/524 |
| 2011/0107784 | A1 | 5/2011 | Tippmann et al. | |

OTHER PUBLICATIONS

Office Action dated Nov. 21, 2013 in U.S. Appl. No. 12/879,521.
Response to Office Action dated Jan. 22, 2014 in U.S. Appl. No. 12/879,521.
Office Action dated Feb. 13, 2014 in U.S. Appl. No. 12/879,521.
Response to Office Action dated Aug. 13, 2014 in U.S. Appl. No. 12/879,521.
Response to Office Action dated Jun. 18, 2013 in U.S. Appl. No. 12/879,521.
University of California, "Commercial Cooling of Fruits, Vegetables and Flowers", Revised Edition 2002, e.g., Chapter 2, Forced-Air Cooling, including Figure 7.
Office Action dated Mar. 18, 2013 in U.S. Appl. No. 12/879,521.
Planning and Engineering Data. 3. "Fish Freezing", U.S. Fisheries and Aquaculture Department, 1984.
"Thermal Tech Acquires Cool Care", Thermal Tech News, Colume 5, No. 1, Spring 2002.
"Go Tarpless!", Therman Technologies Incorporated, 2004.

* cited by examiner

PRODUCT
PRODUCT
PRODUCT 20
22
22
22
22
4
26
26
26
34
34
34
34
34
38
38
38

RACK-AISLE FREEZING SYSTEM FOR PALLETIZED PRODUCT

This application claims the benefit under Title 35, U.S.C. §119(e) of U.S. Provisional Patent Application Ser. No. 61/241,065, titled RACK-ISLE FREEZING SYSTEM FOR PALLETIZED PRODUCT, filed on Sep. 10, 2009, the disclosure of which is expressly incorporated by reference herein.

The present disclosure relates to a warehouse or structure that mass freezes and stores bulk foods and other products.

Figure 1:
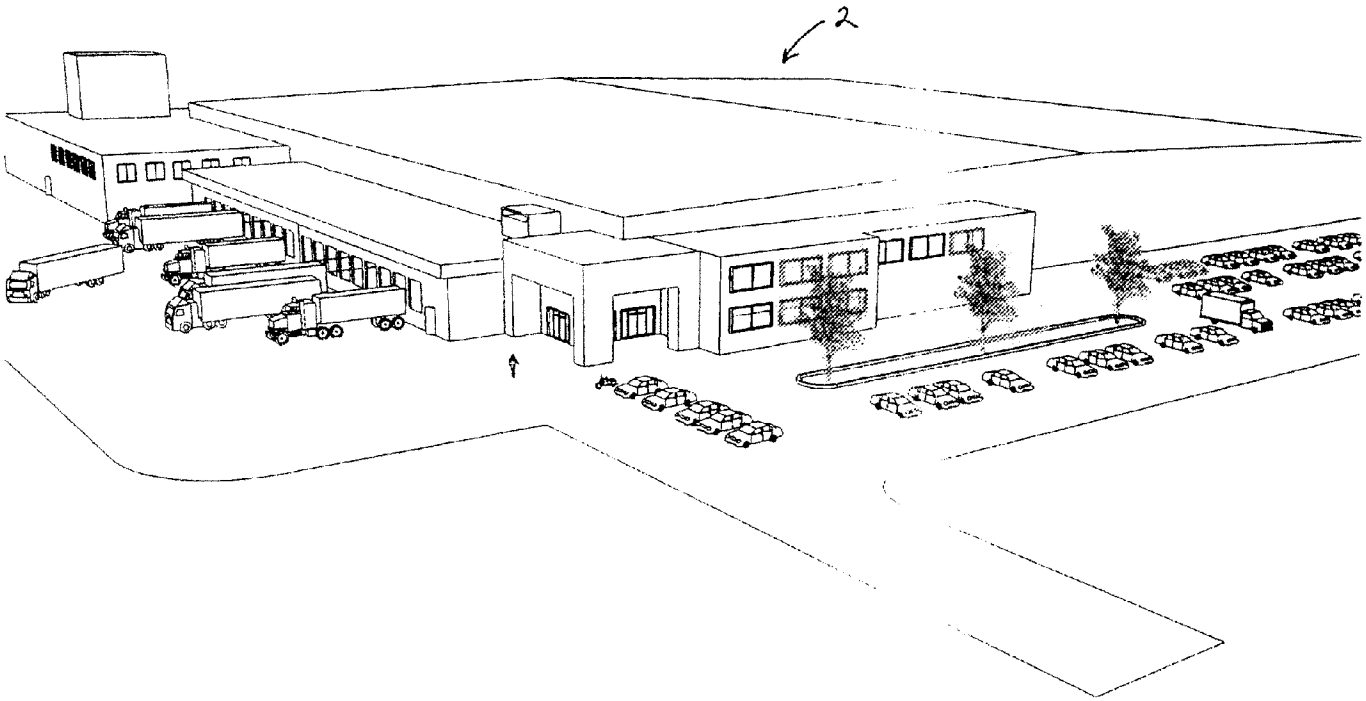
FIG. 1 is a perspective view of a warehouse incorporating a freezing system in accordance with the present disclosure.

According to the present disclosure, a large warehouse, building, or structure, such as warehouse 2 shown in FIG. 1, is used as a giant freezer that both freezes and maintains perishable foods or like products. Large pallets of items such as meats, fruits, vegetables, and prepared foods can be taken to this warehouse and promptly frozen in blast rooms. The product is then moved to the storage part of the warehouse where it is maintained at a frozen temperature until removed.

Unlike two-stage freezer warehouses, this disclosure describes a specially configured rack system that assists freezing the product directly in the open warehouse space. In essence, the system described herein is a one-stage freezing storage system, rather than a multi-stage freezing storage system. It is appreciated that fresh-packed fruits, vegetables, and other products can be chilled to a desired temperature.

Figure 2:
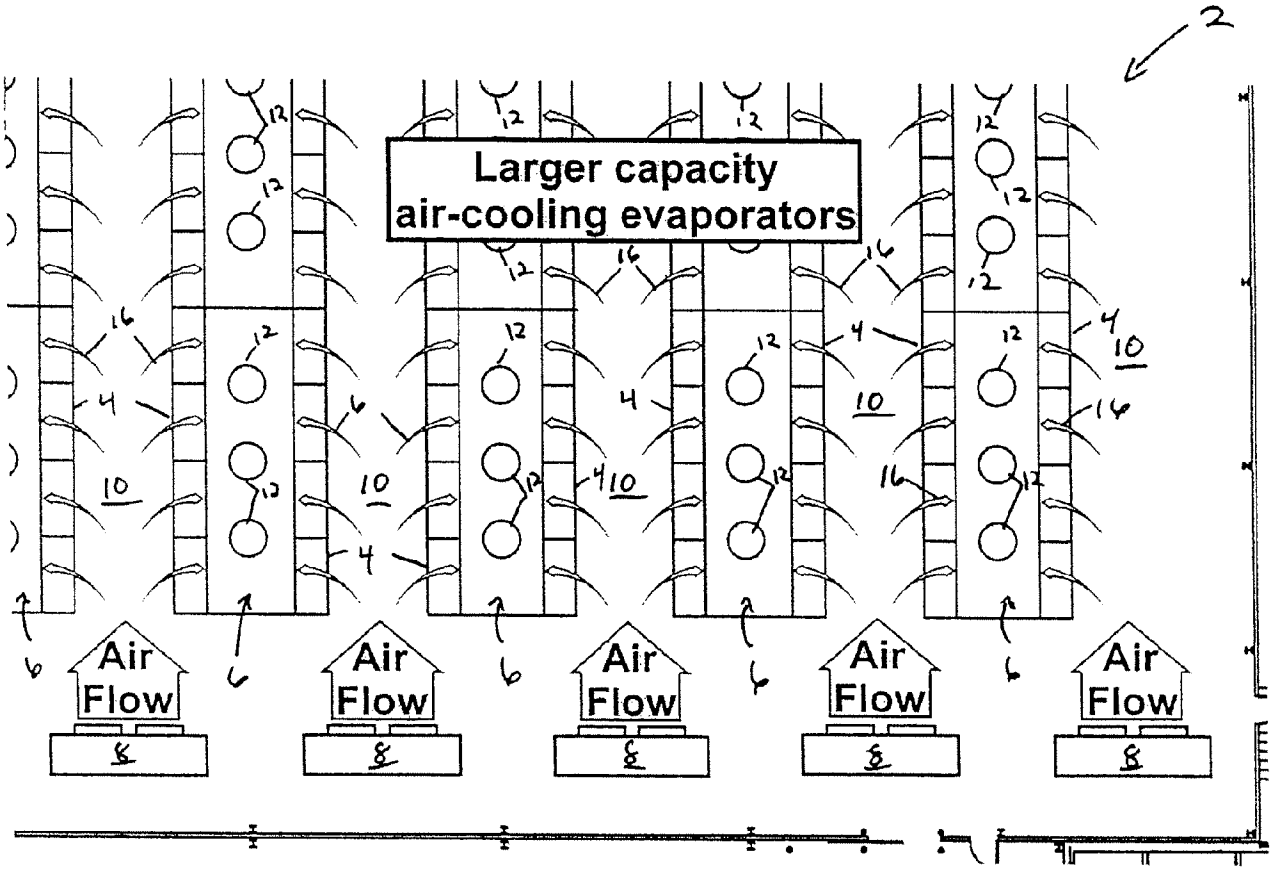
FIG. 2 is a diagrammatic top view of a freezer warehouse incorporating the system of the present disclosure.

A top view of the inside of warehouse 2 shown in FIG. 2 depicting several rows of palleted product. Each pallet 4 abuts a chamber 6. In this illustrative embodiment, pallets 4 are positioned several high on opposing sides and along chamber 6. Cold air produced in warehouse 2 is drawn through spacers 20 (see FIG. 6) separating rows of cases of product on the pallet. This air cools the product down while being drawn into chamber 6 indicated by directional arrow 16. In an illustrative embodiment, and as further discussed herein, openings 30 along the periphery of chamber 6 mate with cases 22 on the pallets 4 (see FIG. 9). The only significant way to move the cold air inside warehouse 2 is by going through and/or around the product on pallet 4. The air 16 drawn into chamber 6 can then be recooled and recirculated, or exhausted. Because the cold air moves around product prior to entering chamber 6, it provides an efficient means for freezing.

Chillers 8 inside warehouse 2 produce the cold air that flows through aisles 10 and into chambers 6. It is appreciated that chillers 8 can be positioned in different locations as needed inside warehouse 2. As shown in FIG. 2, chillers 8 are positioned remotely from chambers 6. The chilled air passes through open spaces near or through cases of product in order to enter chamber 6. Air handlers, such as fans 12 inside or in air flow communication with chamber 6 assist in drawing the air within warehouse 2 through the palletized and/or through the product cases and into the channel. Continuing this process freezes the product as well as maintains its frozen condition. Without blast freezers that initially freeze product only to then move it to warehouse aisles, more space can be dedicated to either more rows of chambers 6 or more aisle space 10. Increasing capacity or maneuvering room in a warehouse is beneficial.

Figure 3:
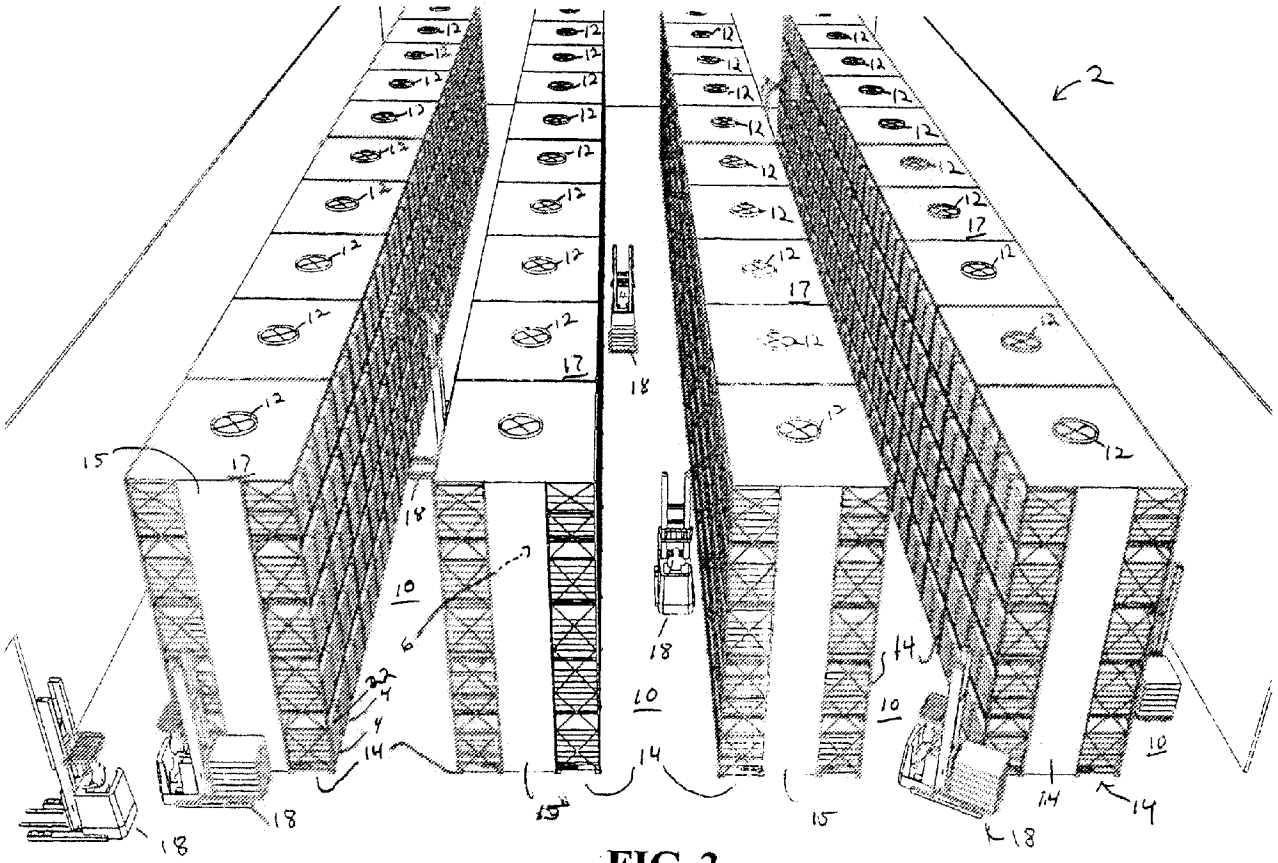
FIG. 3 is a perspective view of the interior of the freezer warehouse.

A top perspective view of the inside of warehouse 2 is shown in FIG. 3, This view shows rows of racking 14 between aisles 10 and chamber 6. In this view the actual chambers 6 are obscured because end caps 15 are covering their ends. A plurality of fans 12 are shown at the top with top panel 17 covering chamber 6. This view demonstrates how aisles 10 can be widened to accommodate more forklifts 18. This view also shows how many cases of product on pallets 4 can be stacked in these rows. In this illustrative embodiment, the pallets are stacked five high. This number can vary, however, depending on the needs of the warehouse and the size, configuration, and weight of the cases on the pallets. The space savings can also be appreciated from this view. The entire warehouse uses the same rows to both cool and store palleted product. This is more efficient than a conventional warehouse having separate blast freezing rooms. This new configuration not only requires less space, but it also no longer requires transporting the pallet from the blast room to a separate storage location in the warehouse.

Figure 4:
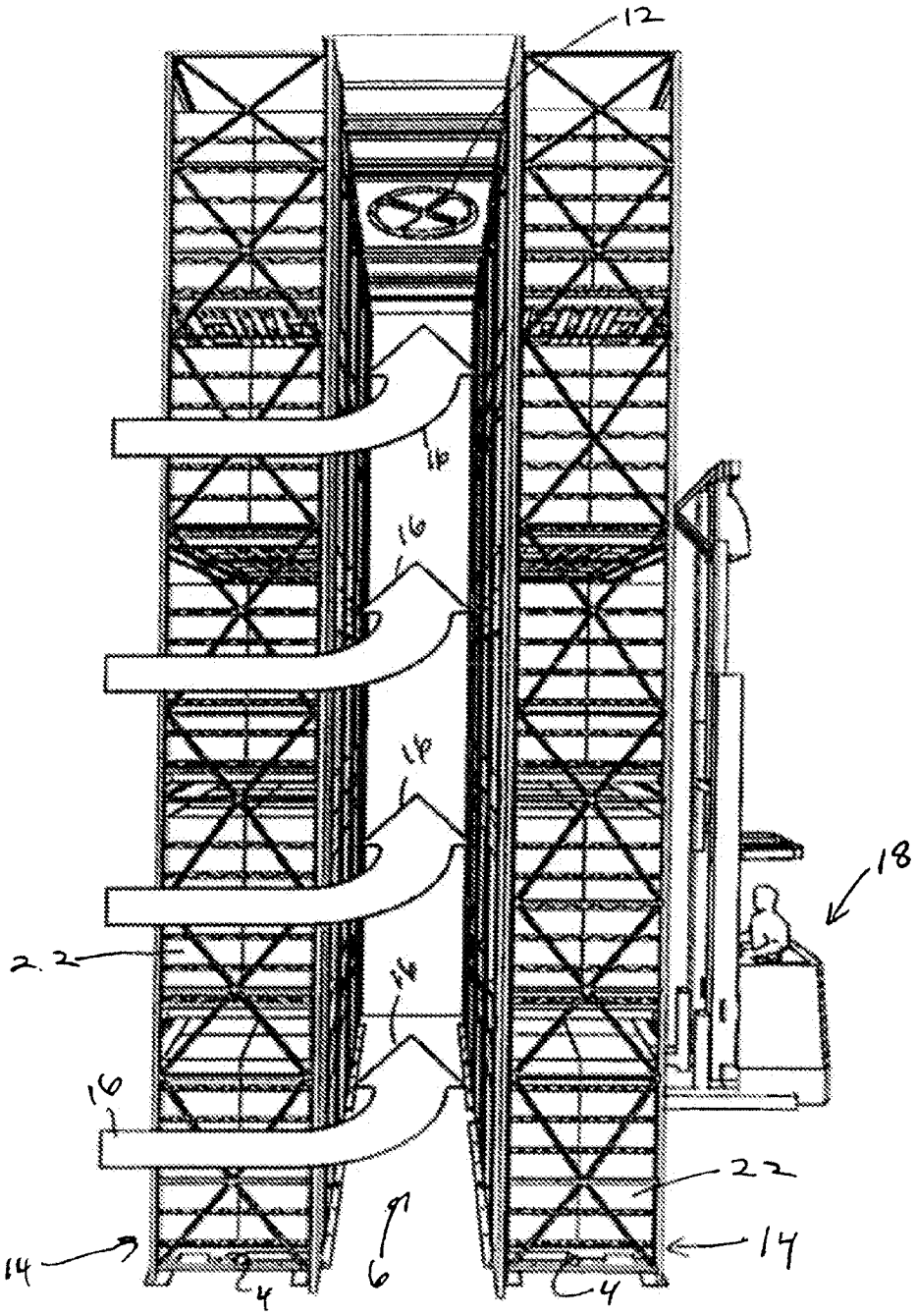
FIG. 4 is a perspective end view showing a racking arrangement.

An end view of chamber 6 with racking 14 on each side holding pallets 4 is shown in FIG. 4. As further illustrated, fan 12 draws air in as indicated by directional arrow 16 through and around cases of product 22 on pallets 4 before entering chamber 6. End cap 15 has been removed from this view, but otherwise prevents air from entering chamber 6 at the end of the row. It is appreciated that in this illustrative embodiment, storage management in warehouse 2 can also be improved by using a single pallet deep configuration. There is now more room for forklift 18 to maneuver, as well as pick and stack product.

Figure 5:
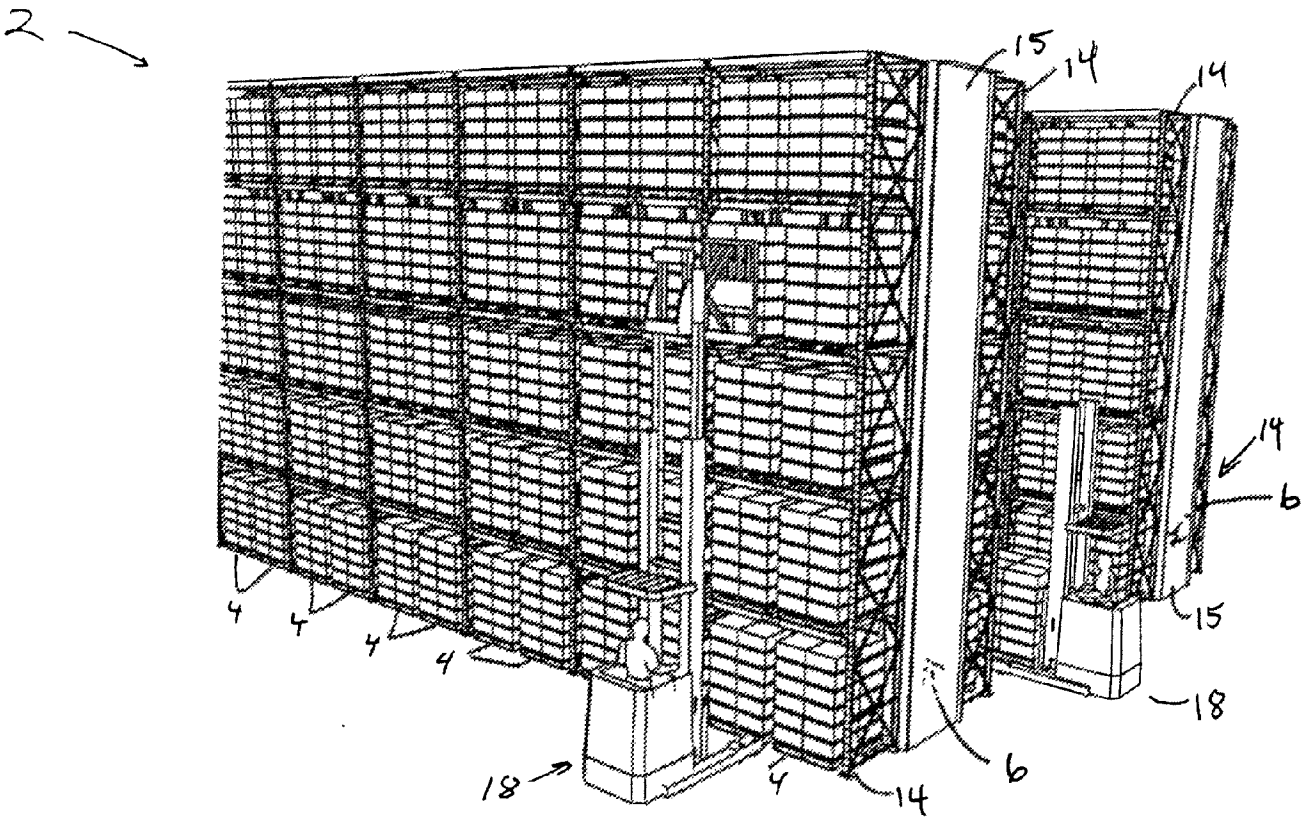
FIG. 5 is a perspective view of two rows of racking.

Another perspective view of chamber 6 located between rows of racking 14 is shown in FIG. 5. This view further demonstrates the ease within which pallets 4 of product can be accessed by forklift 18 during freezing or while maintaining their frozen condition. Conventional cooled warehouses store their pallets of product two or more pallets deep. This creates a less efficient stocking and retrieval system.

Figure 6:
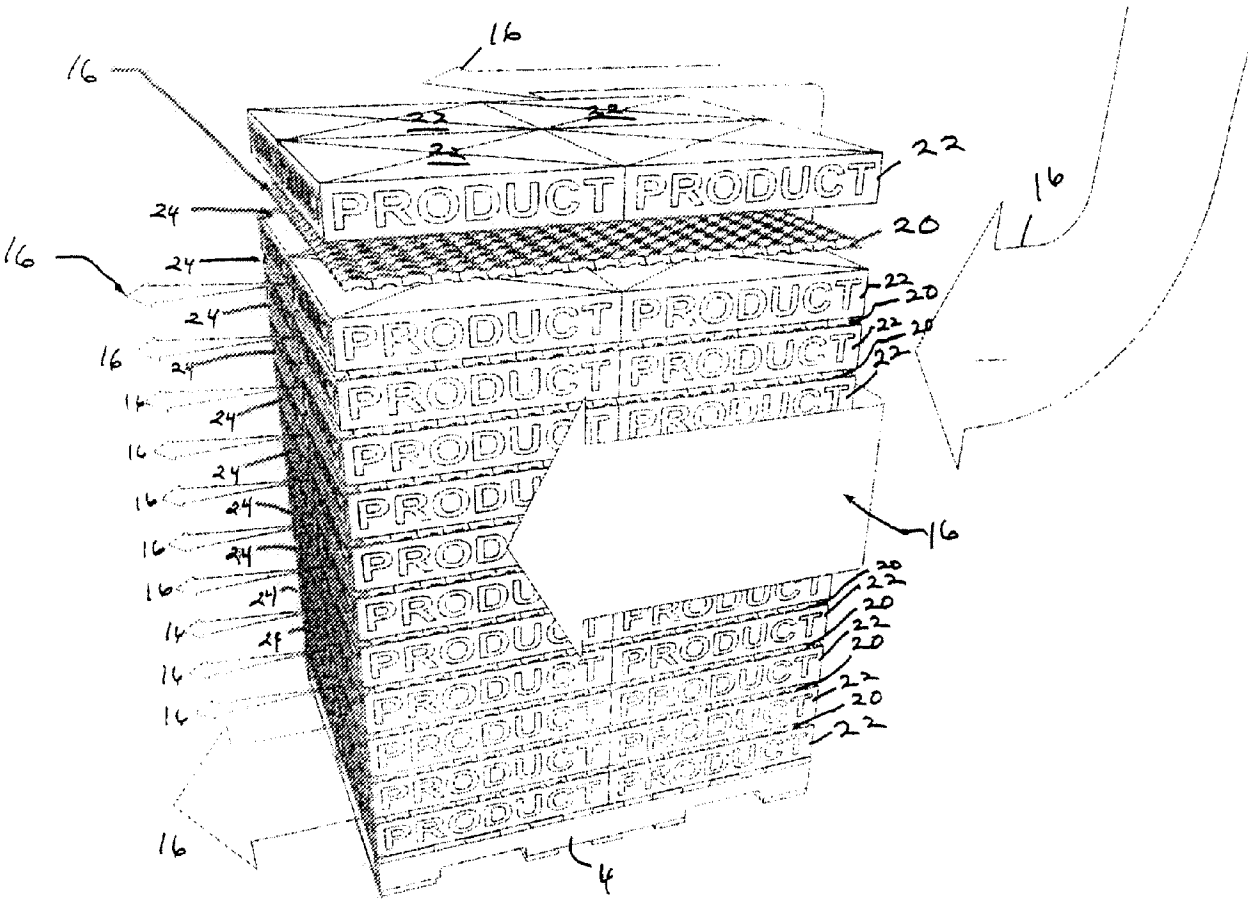
FIG. 6 is a diagrammatic perspective view showing the flow of chilling air through the palletized product.

An illustrative pallet 4 of cases 22 of product is shown in FIG. 6. In this illustrative embodiment, a freezer spacer 20 is placed between rows of individual cases 22 of product in order to provide air pathways 24. In addition, pathways 24 provide more passages through which air flow can enter chamber 6. Illustratively, spacers 20 can be made from a plastic mesh. Alternatively, they may be strips of solid material, such as wood or metal. It is contemplated that other like materials and structures can work to create air pathways by separating one row of cases 22 from another. It is further appreciated that some containers, such as turkey and ham boxes, for example, are fabricated with holes in the sides intended to allow air-flow for quicker freezing. Stacks of these cases may not require the spacers in order to freeze properly using the system disclosed herein.

Figure 7:
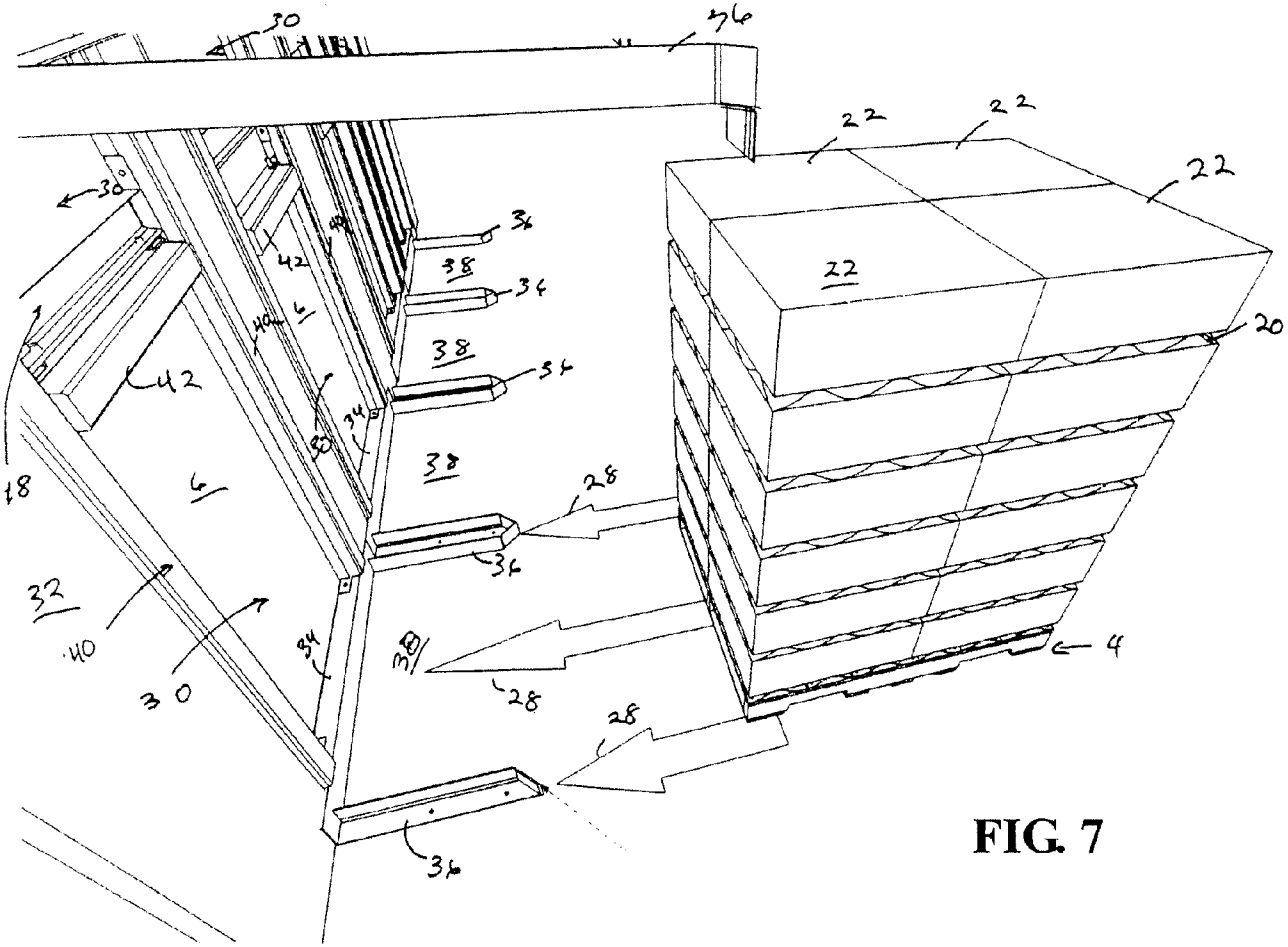
FIGS. 7 and 8 show loading of the palletized product into the racks.

A perspective view of a pallet 4 supporting a plurality of cases 22 and moving in direction 28 toward chamber 6 is shown in FIG. 7. To assist facilitating moving the chilled air from warehouse 2 into chamber 6, a plurality of openings 30 are positioned in wall 32 of racking 14. Wall 32 along with covers 17 and end cap 15 form chamber 6 (see, also, FIG. 3). In this embodiment, pallet 4 is positioned against periphery 34, 40, and 42 of air intake opening 30 preventing air from entering chamber 6 except through and around cases 20. To assist in this endeavor, spaced apart pallet support guides 36 are positioned at the illustratively lower end periphery 34. The space 38 between pallet guides 36 receives pallet 4 ensuring stacked cases 22 will be properly positioned in front of opening 30. It is appreciated that, as seen in FIGS. 4 and 5, for example, pallets can be stacked vertically. It is further appreciated that for each pallet 4 there is a pair of pallet guides 36 or like structures to help guide it to the opening. It is also appreciated that there can be multiple openings 30 both vertically and laterally along both sides of chamber 6 that employ multiple pairs of channel guides 36.

Figure 8:
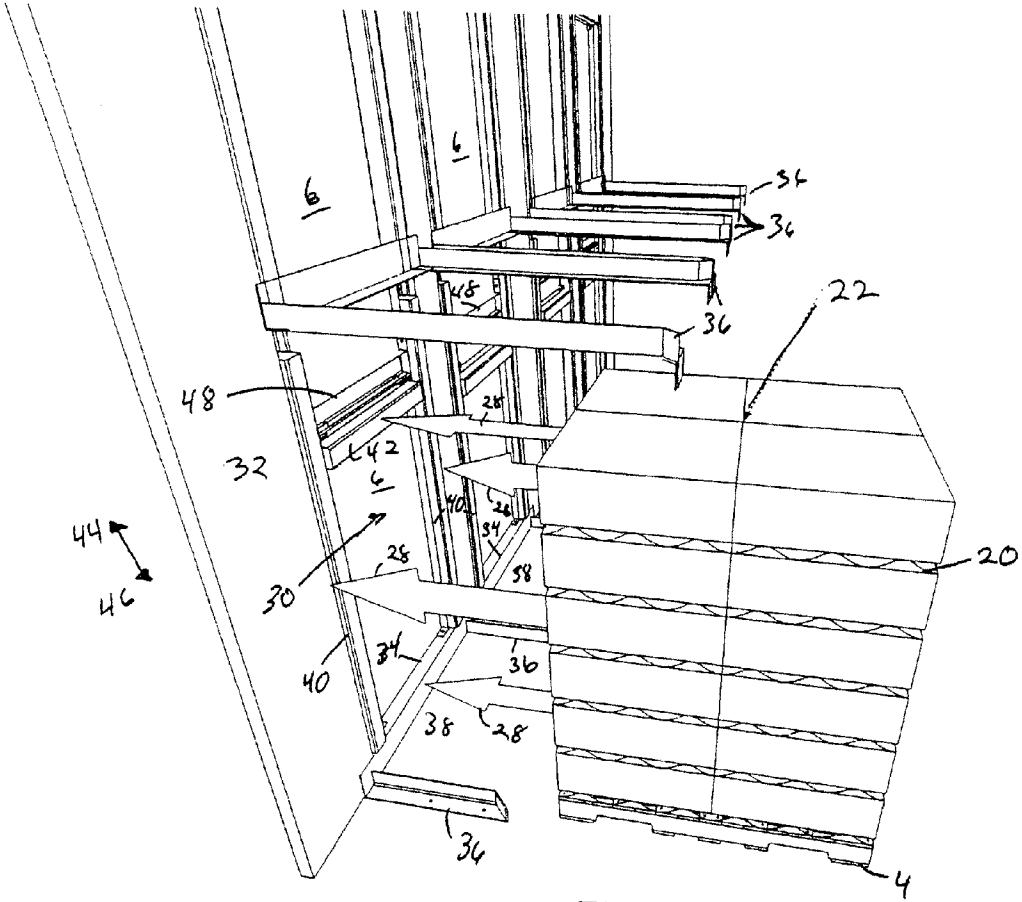

Another perspective view of pallet 4 moving in direction 28 towards opening 30 is shown in FIG. 8. This view shows seals 40 and 42 positioned about the periphery 34, 40, and 42 of opening 30. It is appreciated that cases 22 will abut against seals 34, 40, and 42 to mitigate the potential for air to enter chamber 6 adjacent wall 32, without first going over and around cases 22. It is further appreciated that there can be upper and lower horizontal seals 42 and 34, respectively, that abut the top and bottom rows of cases 22 on pallet 4.

It is further appreciated that seal 42 can be selectively vertically adjustable in directions 44 and 46 via adjustable bracket 48 to abut the top row of cases 22 on pallet 4. In the illustrative embodiment, bracket 42 may include detents, pins, or other structures that selectively engage corresponding recesses, holes, etc., to secure bracket 48 to a desired height. This flexibility is useful because depending on the product being frozen, the pallet height may vary. Directing airflow through and around cases 22 on pallet 4 means it is preferable not to have an opening either above or below the product which would create a non-desirable path of least resistance for the air to flow to enter chamber 6. It is contemplated that for each stack of pallets, adjustable panel 48 can be moved to the desired position depending on the height of cases 22. This view also shows a second upper row storage system for pallets 4 that includes additional pallet guides 36 to assist maintaining proper positioning of pallets 4 along a column. It is further contemplated that additional adjustment brackets can be moved to the appropriate location that directs air through pallets 4, rather than just around them. It is still further appreciated that the configuration of racking 14 with openings 30 and guides 36 can all be configured to accommodate conventional palleting and pallet stacking systems used in a variety of warehouse environments.

Figure 9:
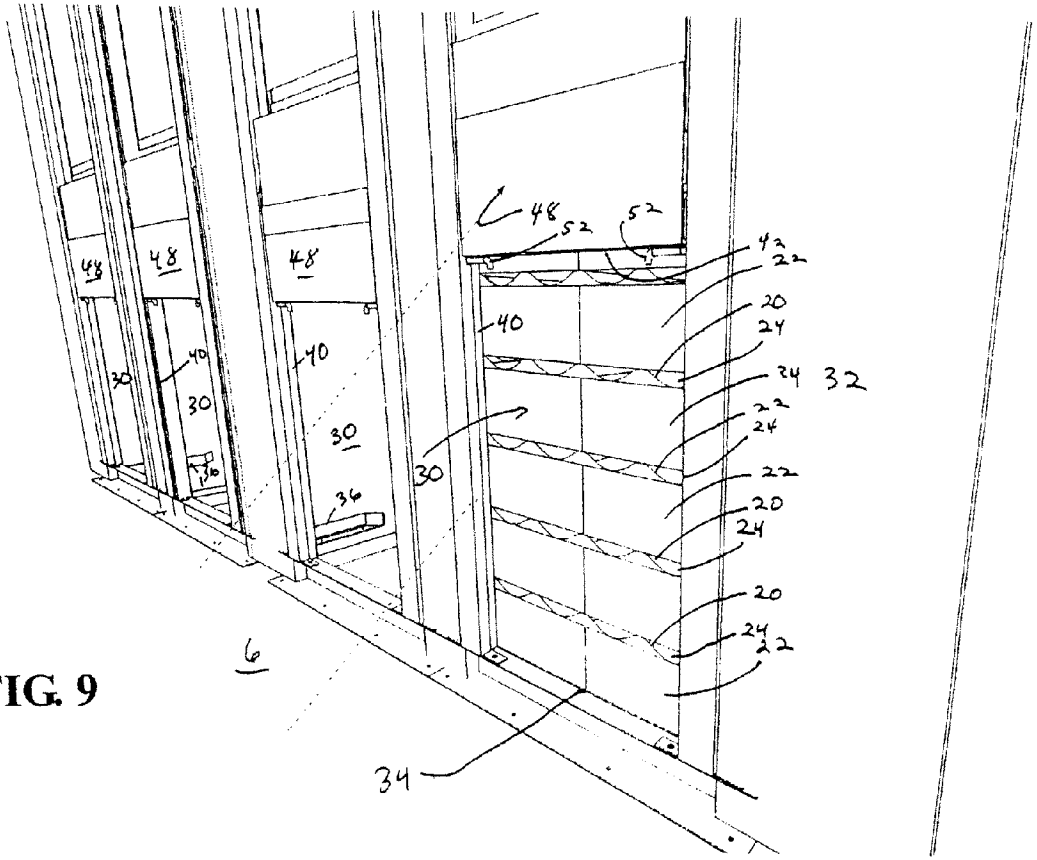
FIG. 9 is a perspective view of the racking structure as seen from the interior air chamber.

A perspective view inside chamber 6 looking toward opening 30 with pallet 4 and cases 22 pushed up against seals 34, 40 and 42 is shown in FIG. 9. From this perspective, it is appreciated that the combination of cases 22, spacers 20, and seals 34, 40 and 42 generally prevent airflow from entering chamber 6 except through space 24 created by spacers 20. This embodiment also shows a panel 48 placed above pallet 4 preventing air from simply entering chamber 6 above cases 22. It is appreciated that panel 48 is not only adjustable, but can also be either separate or attached to seal 42 as needed to provide the flexibility allowing stacked pallets 4 of a variety of heights to limit airflow into chamber 6. This view also shows illustrative panel 48 and pins 52 that illustratively engage the periphery 30 of periphery 34 to selectively hold panel 48 in place. It is appreciated that a variety of latches, clasps, etc., can be used to hold structures that prevent air from flowing into chamber 6 from undesired regions. This view shows additional panels 50 along the row of racking 14 that are configured to receive additional pallets that are subject to the same restriction of airflow flowing through the cases 22.

Figure 10:
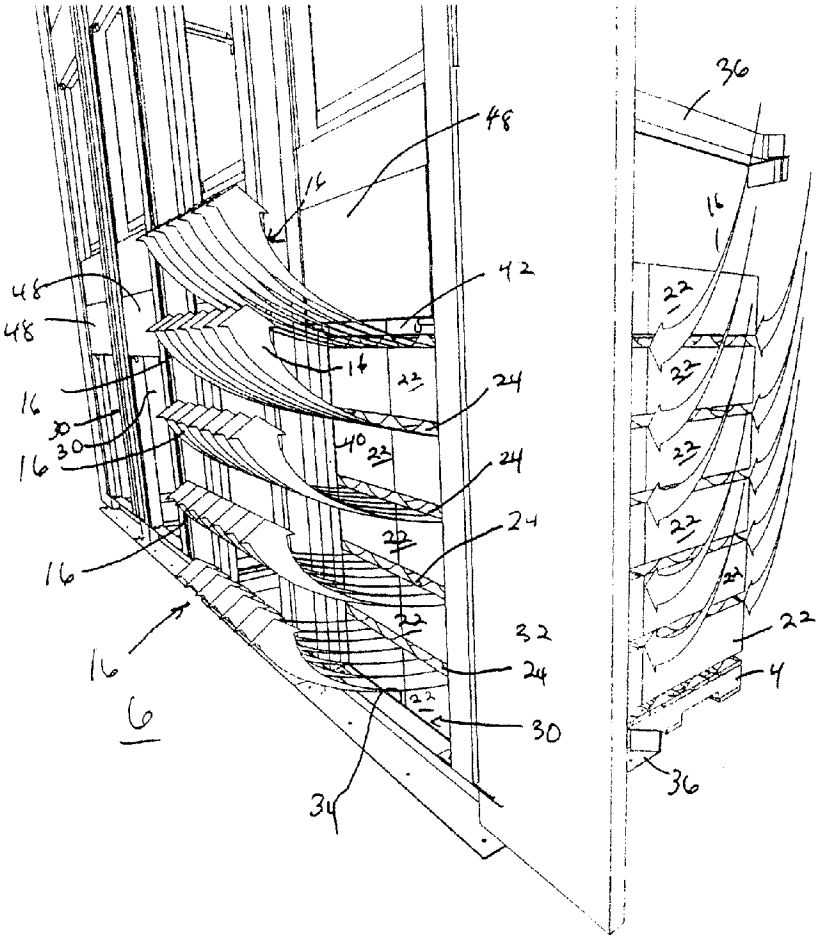
FIG. 10 is a diagrammatic view showing the flow of air through the palletized product into the interior air chamber.

Another perspective view from inside chamber 6 is shown in FIG. 10. This view demonstrates the airflow 16 that occurs when pallet 4 and cases 22 are pressed against the periphery 34, 40, and 42 of opening 30, as shown from the inside of warehouse 2. The predominate pathways are the spacings 24 created by spacers 20 between cases 22. This chilled air passes over and under each case 22 reducing their temperature until it reaches freezing. Once frozen, cold air can be used to maintain the frozen state of the product inside cases 22 until they are ready to be removed from warehouse 2.

Corresponding reference characters indicate corresponding parts throughout the several views. The exemplification set out herein illustrates an embodiment of the invention, in one form, and such exemplification is not to be construed as limiting the scope of the invention in any manner. Although the present disclosure has been described with reference to particular means, materials and embodiments, from the foregoing description, one skilled in the art can easily ascertain the essential characteristics of the invention and various changes and modifications may be made to adapt the various uses and characteristics without departing from the spirit and scope of the invention.

What is claimed is:

1. An installation for warehousing pallets of product, comprising:
   - a warehouse defining a warehouse space set to a desired air temperature; and
   - a pallet racking assembly disposed in the warehouse space, the pallet racking assembly comprising:
     - a pallet receiving space sized and configured to receive a pallet assembly including a pallet and a plurality of vertically stacked rows of cases disposed on the pallet and providing an airflow pathway through the vertically stacked rows of cases;
     - an airflow chamber including an air inlet and an air outlet;
     - a fan positioned to direct air into the airflow chamber from the air inlet and exhaust air into the warehouse space through the air outlet; and
     - a wall disposed between the pallet receiving space and the airflow chamber, the wall having an airflow opening defining an opening periphery, the opening sized and positioned to be sealingly engaged by the pallet assembly when the pallet assembly is pressed against the opening periphery, whereby the air at the desired air temperature can pass into the airflow pathway of the pallet assembly to thereby transfer heat between the product and the air.

2. The installation of claim 1, in combination with the pallet assembly received in the pallet receiving space and sealingly engaged with the opening.

3. The installation of claim 2, wherein the pallet assembly includes a spacer disposed between respective vertically stacked rows of cases, the spacer providing the airflow pathway by separating respective ones of the plurality of vertically stacked rows of cases from one another.

4. The installation of claim 3, wherein the spacer is made from at least one of a plastic and strips of solid material.

5. The installation of claim 2, wherein the air inlet comprises the opening in the wall such that, when the pallet assembly is sealingly engaged with the opening, air received through the air inlet is air flowing through the airflow pathway of the pallet assembly.

6. The installation of claim 1, wherein the air inlet comprises the airflow opening in the wall.

7. The installation of claim 6, wherein the fan is disposed at the air outlet.

8. The installation of claim 1, further comprising an air conditioner operably connected to the warehouse space to deliver conditioned air to the warehouse space, the conditioned air providing the desired air temperature.

9. The installation of claim 8, wherein the air conditioner comprises a chiller producing freezing air, whereby the freezing air can through the airflow pathway of the pallet assembly to thereby quickly freeze the product contained in the vertically stacked rows of cases.

10. The installation of claim 1, wherein the wall of the pallet racking assembly comprises a first wall on a first side of the airflow chamber such that the pallet receiving space comprises a first pallet receiving space at the first side of the airflow chamber, the pallet racking assembly further comprising:

a second pallet receiving space at a second side of the airflow chamber opposite the first side, the second pallet receiving space sized and configured to receive a pallet assembly; and a second wall on the second side of the airflow chamber, the second wall disposed between the second pallet receiving space and the airflow chamber, and having a second airflow opening sized and positioned to be sealingly engaged by the pallet assembly.

11. The installation of claim 1, further comprising a plurality of pallet guides disposed in opposite sides of the opening and defining a space therebetween, the space sized to receive the pallet assembly to ensure that the pallet assembly is properly positioned in front of the opening.

12. The installation of claim 1, wherein the pallet racking assembly comprises:

a plurality of the pallet receiving spaces arranged in vertically spaced horizontal rows; and the wall includes a plurality of the airflow openings respectively disposed at each of the plurality of the pallet receiving spaces, whereby the pallet racking assembly is configured to accommodate multiple pallet assemblies exposed to the air at the desired air temperature via the airflow chamber of the pallet racking assembly.

13. The installation of claim 1, wherein the pallet racking assembly further comprises a seal disposed about the opening periphery and adapted to engage the pallet assembly to facilitate passage of the air at the desired air temperature primarily through the airflow pathway of the pallet assembly.

14. The installation of claim 1, wherein the installation comprises a plurality of the pallet racking assemblies arranged in spaced-apart rows in the warehouse space to form an aisle sufficiently wide to accommodate a forklift to pass through the aisle.

15. The installation of claim 1, wherein the rows of pallet racking assemblies are substantially parallel to each other.

16. An installation for warehousing pallets of product, comprising:

a warehouse defining a warehouse space set to a desired air temperature;

a plurality of pallet assemblies, each pallet assembly comprising:

a pallet; and a plurality of vertically stacked rows of cases disposed on the pallet and providing an airflow pathway through the vertically stacked rows of cases containing the product; and a pallet racking assembly disposed in the warehouse space, the pallet racking assembly comprising:

a plurality of pallet receiving spaces each sized and configured to receive a respective pallet assembly therein;

an airflow chamber including an air inlet and an air outlet;

a fan positioned to direct the air into the airflow chamber from the air inlet and exhaust air into the warehouse space through the air outlet; and a wall disposed between the plurality of pallet receiving spaces and the airflow chamber, the wall having an airflow opening disposed at each of the plurality of pallet receiving spaces, each airflow opening defining an opening periphery sized to be sealingly engaged by a respective pallet assembly, whereby the air at the desired air temperature can pass into respective airflow pathways of the plurality of pallet assemblies to thereby simultaneously transfer heat between the product of the respective vertically stacked rows of cases and the air at the desired air temperature.

17. The installation of claim 16, wherein the air inlet comprises the airflow openings in the wall.

18. The installation of claim 17, wherein the fan is disposed at the air outlet.

19. The installation of claim 16, wherein each of the plurality of pallet assemblies includes a spacer disposed between respective vertically stacked rows of cases, the spacer providing the airflow pathway by separating respective ones of the plurality of vertically stacked rows of cases from one another.

20. The installation of claim 16, further comprising an air conditioner operably connected to the warehouse space to deliver conditioned air to the warehouse space, the conditioned air providing the desired air temperature.

21. The installation of claim 20, wherein the air conditioner comprises a chiller producing freezing air, whereby the freezing air can flow through respective airflow pathways of the plurality of pallet assemblies to thereby quickly freeze the product contained in respective vertically stacked rows of cases.

22. The installation of claim 16, wherein the wall of the pallet racking assembly comprises a first wall on a first side of the airflow chamber such that the plurality of pallet receiving spaces comprises a first plurality of pallet receiving spaces at the first side of the airflow chamber, the pallet racking assembly further comprising:

a second plurality of pallet receiving spaces at a second side of the airflow chamber opposite the first side, each of the second plurality of pallet receiving spaces sized and configured to receive a respective pallet assembly therein; and a second wall at the second side of the airflow chamber, the second wall disposed between the second plurality of pallet receiving spaces and the airflow chamber, and having a second airflow opening disposed at each of the second plurality of pallet receiving spaces, each of the second plurality of pallet receiving spaces sized and positioned to be sealingly engaged by the pallet assembly.

* * * * *